US009816359B2

(12) United States Patent
Wolf et al.

(10) Patent No.: US 9,816,359 B2
(45) Date of Patent: Nov. 14, 2017

(54) WELLBORE DESANDING SYSTEM

(71) Applicant: NATIONAL OILWELL VARCO, L.P., Houston, TX (US)

(72) Inventors: Mark E. Wolf, Katy, TX (US); Tariq Ahmed, Houston, TX (US); Gareth David Thomas, Hollingworth (GB)

(73) Assignee: National Oilwell Varco, L.P., Houston, TX (US)

( * ) Notice: Subject to any disclaimer, the term of this patent is extended or adjusted under 35 U.S.C. 154(b) by 371 days.

(21) Appl. No.: 14/420,326

(22) PCT Filed: Aug. 6, 2013

(86) PCT No.: PCT/US2013/053871

§ 371 (c)(1),
(2) Date: Feb. 6, 2015

(87) PCT Pub. No.: WO2014/025835

PCT Pub. Date: Feb. 13, 2014

(65) Prior Publication Data

US 2015/0226046 A1 Aug. 13, 2015

Related U.S. Application Data

(60) Provisional application No. 61/680,090, filed on Aug. 6, 2012.

(51) Int. Cl.
*F04B 47/02* (2006.01)
*E21B 43/12* (2006.01)
(Continued)

(52) U.S. Cl.
CPC ..... *E21B 43/121* (2013.01); *E21B 37/00* (2013.01); *E21B 43/126* (2013.01);
(Continued)

(58) Field of Classification Search
CPC ..... E21B 43/126; E21B 43/128; E21B 43/12; E21B 43/121; F04B 47/005; F04B 47/06
(Continued)

(56) References Cited

U.S. PATENT DOCUMENTS 2,512,764 A * 6/1950 Byram ..... F04C 2/1073 417/412
3,677,665 A 7/1972 Corkill
(Continued)

FOREIGN PATENT DOCUMENTS

WO WO2011025591 A1 3/2011

OTHER PUBLICATIONS

International Search Report, PCT/US2013/053871, dated Oct. 9, 2014.

*Primary Examiner* — Kenneth L Thompson
(74) *Attorney, Agent, or Firm* — Derek V. Forinash; Porter Hedges LLP

(57) ABSTRACT

The invention relates to system and method for desanding an oil well that includes a fluidizing device (TORE), connected to a downhole pump that connects to a production tubing such that a supply duct is connected to the discharge of the pump and a discharge duct is connected to the suction of the pump. Embodiments include a pressure balance transition device between the TORE and the pump and/or a flow splitting device in the production tubing after the discharge of the pump. Other embodiments relate to a system and method for desanding an oil well in which a fluidizing unit is connected to a pump such that the supply duct is connected to an opening in the pump body or pump rotor and a discharge duct is connected to the suction of the pump. If connected to the rotor, the supply duct is integral to the pump rotor.

16 Claims, 3 Drawing Sheets

(51) Int. Cl.
*E21B 37/00* (2006.01)
*F04C 13/00* (2006.01)
*F04C 2/107* (2006.01)

(52) U.S. Cl.
CPC ..... *F04C 2/1071* (2013.01); *F04C 13/00* (2013.01); *F04C 13/008* (2013.01)

(58) Field of Classification Search
USPC ..... 166/105.1, 105.4; 417/430, 431
See application file for complete search history.

(56) References Cited

U.S. PATENT DOCUMENTS

| | | | | |
|---|---|---|---|---|
| 4,952,099 | A | 8/1990 | Drobadenko et al. | |
| 4,978,251 | A | 12/1990 | Drobadenko et al. | |
| 4,992,006 | A | 2/1991 | Drobadenko et al. | |
| 5,562,159 | A | 10/1996 | Smith et al. | |
| 5,853,266 | A | 12/1998 | Parkinson et al. | |
| 5,934,372 | A * | 8/1999 | Muth | E21B 33/122 166/117 |
| 7,975,765 | B2 * | 7/2011 | Manson | E21B 37/00 166/105 |
| 2011/0017459 | A1 | 1/2011 | Dinkins | |
| 2012/0211228 | A1 | 8/2012 | Troshko et al. | |
| 2015/0159472 | A1 * | 6/2015 | Wolf | E21B 43/08 166/313 |

* cited by examiner

WELLBORE DESANDING SYSTEM

This application is a 371 filing of International Patent Application PCT/US2013/053871 filed Aug. 6, 2013, which claims the benefit of U.S. application No. 61/680,090 filed Aug. 6, 2012.

FIELD OF THE INVENTION

The present invention generally relates to a method and system for desanding an oil well by hydrodynamically fluidizing liquid and solid mixtures in said well and transporting them to the surface. More specifically, the invention relates to a method and system for adapting TORE solids fluidizing technology to remove accumulated solids from a producing wellbore.

BACKGROUND OF THE INVENTION

Wells that produce heavy oil from low pressure reservoirs require some form of artificial lift, such as pumping for example, from the bottom of the wellbore to raise the fluids to the surface. These wells may be produced without sand screens or other forms of downhole sand control that would limit the wells' productivity. As a result, wells of this type are prone to produce significant quantities of sand. In many cases, the upward velocity of the production fluids in the wellbore is not sufficient to lift the sand with the fluid production, and a portion of the sand settles to the bottom of the well. Over time, the sand in the bottom of the well covers up the portion of the well that is open to the oil reservoir, effectively blocking the flow of fluids from the reservoir into the wellbore. It may also plug or restrict the flow into the pump. The current method of solving such a problem requires a workover rig, crane and/or a coiled tubing unit to remove the pump and flush the sand out of the well.

Employing liquid pressure for long-range conveyance of materials in bulk is described by U.S. Pat. No. 4,992,006 to Drobadenko et al., incorporated herein by reference. However, the invention of the '006 patent is of particular use in the mining industry, construction, metallurgy and agriculture. It discloses a device for hydraulic conveyance of loose materials with a toroidal chamber having an equatorial plane thereof set with respect to a horizontal plane at an angle dependant on the internal friction of the loose material, when saturated with the liquid used for hydraulic conveyance. The chamber is provided with pipes for charging the loose material and for discharging the liquid, both of the pipes being arranged on one side with respect to the meridianal plane, and a slurry discharge unit arranged on its other side.

U.S. Pat. No. 4,952,099, also to Drobadenko et al., incorporated herein by reference, describes a device for hydraulic conveyance of loose materials with four pipes, one for liquid discharge, the second for loose material charging, the third for feeding the pressure liquid flow and a fourth for slurry discharge in an upward flow. The pipes are held by a hemispherical cover and are arranged coaxially in such a manner that the loose material charging pipe is accommodated inside the liquid discharge pipe, the pressure liquid flow feeding pipe is accommodated inside the loose material charging pipe, and the slurry upward flow discharging pipe is accommodated inside the pressure liquid flow feeding pipe, all of the pipes being arranged coaxially with the longitudinal axis of a housing chamber and having some of their portions located inside the chamber.

U.S. Pat. No. 4,978,251, to Drobadenko et al., incorporated herein by reference, describes a method and an apparatus for conveying materials in bulk by liquid pressure. The method is carried out by an appropriate apparatus and involves loading a material in bulk into a chamber through a loading pipe and then supplying liquid under pressure through a pipe for supplying liquid in the form of a downward annular flow, and discharging the material in bulk in an upward flow through a discharge pipe mounted to extend coaxially with, and inside the pipe for supplying liquid. A zone of recirculation flows of liquid is formed in the chamber by swirling the annular flow to an extent determined by a ratio of the rotational component of velocity to the axial component of velocity at least equal to 0.4. The material in bulk is discharged in the zone of recirculation flows.

Prior patents '009 and '251 both require a pressurized container or vessel that is loaded with solids when it is not under pressure and then sealed and pressurized in order to fluidize and transport solid material in a slurry. It is impossible to install and operate a pressurized container within a wellbore that could be loaded and then sealed in this manner.

U.S. Pat. No. 5,562,159, assigned to Merpro Tortek Limited, incorporated herein by reference, describes a well uplift system to raise material, such as production fluid, from a bore hole that involves pumping water down a pipe to a fluidizing unit (TORE) so that the water activates and entrains the material and carries it up through a discharge conduit to a separator for at least partially separating the fluid and the material. The supply duct in the '159 is connected to a water source at the surface of the well and the discharge duct is connected to a conduit that runs to the surface. However, these features of the '159 invention create a pressure at the bottom of the well (due to the static head of the water column within the supply duct from the surface) that is greater than the pressure within the reservoir in the vast majority of wells that could benefit from this technology. This pressure from the supply duct halts the passing of fluids from the reservoir into the well. In order for the '159 invention, which does not require any artificial lift, to function properly, the pressure in the reservoir would have to be sufficient to lift the fluids to the surface and overcome the static head that would be imposed on the reservoir from the water supply conduit. Since the problem of high sand production is typically not existent in wells with high reservoir pressure, the previous invention has limited commercial applicability for low pressure reservoirs that produce significant quantities of sand that needs to be removed. In addition, there is the added challenge and cost of providing a separate water supply conduit from the surface to the TORE.

U.S. Pat. No. 5,853,266 to Merpro Tortek Limited, also incorporated herein by reference, teaches an improvement to the fluidizing unit of the kind described in the above patents. Specifically, a fluidising unit comprising a supply duct which is arranged to be fed with liquid under pressure, and a discharge duct within the supply duct and projecting beyond the outlet of the supply duct. The end of the supply duct is closable when the fluidizing unit is not in use. A screen is associated with the supply duct, the screen having at least one oblique opening, and being positioned so that liquid passing through the supply duct passes through the or each opening in the screen and is caused to swirl.

Accordingly, there is a need for improved methods and systems, for preventing the accumulation of solids that can stop the flow of fluids into a well, that are not subject to the disadvantages of the prior art. These are now provided by the present invention.

SUMMARY OF THE INVENTION

The current invention basically relates to a wellbore desanding system having a fluidizing device that comprises a supply duct and a discharge duct; and a pump functionally connected to the fluidizing device and comprising a discharge end and a suction end such that the supply duct is connected to the discharge end of the pump and the discharge duct is connected to the suction end of the pump. The current invention relates to a wellbore desanding system comprising a fluidizing device in the well such as at the bottom of the well to continuously fluidize and lift solids from the well bottom thereby preventing accumulation of solids in the well, wherein the fluidizing device is connected to a downhole pump which in turn connects to a production tubing such that the supply duct (water supply conduit for example) is connected to the discharge of the pump and a discharge duct is connected to the suction of the pump. In an embodiment of the invention the fluidizing device is placed below the casing perforations in the bottom of the well.

An embodiment of the wellbore desanding system of the current invention comprises a fluidizing device having a supply duct and a discharge duct; and a pump functionally connected to the fluidizing device and comprising a discharge end and a suction end such that the supply duct is connected to the discharge end of the pump and the discharge duct is connected to the suction end of the pump and the system further comprises a pressure balance transition device that receives the sand laden fluid from the fluidizing device (TORE), mixes it with the well production fluids from the well casing and feeds the combined stream to the inlet of the pump. The pressure balance transition device may be designed so that well fluid entering the transition device from the well casing passes through a restricted area in order to create a zone of low pressure within the transition device. The difference in pressure between the casing and the transition device provides the energy required to lift the heavier sand laden fluid from the TORE discharge through the small diameter conduit and into the transition device. In an aspect of the invention, the pressure balance transition device is located between the TORE and the pump.

A further embodiment of the wellbore desanding system according to the present invention comprises a fluidizing device having a supply duct and a discharge duct; and a pump functionally connected to the fluidizing device and comprising a discharge end and a suction end such that the supply duct is connected to the discharge end of the pump and the discharge duct is connected to the suction end of the pump and the system further comprises a flow splitting device located in the production tubing just after the discharge of the downhole pump. This device diverts a portion of the fluids discharged from the pump into the conduit that is connected to the supply duct of the TORE. The flow splitting device may include a restriction that will reduce the pressure from the discharge of the pump and control the flow to the supply duct of the TORE. In another embodiment of the invention, the flow splitting device includes an opening to the casing comprising a non-return valve (check valve) that only allows fluids to enter the conduit connected to the TORE supply duct.

In an embodiment of the wellbore desanding system of the current invention, the discharge port is added to the pump body or to the pump rotor that allows fluids to be directed to the TORE at the appropriate pressure that is required to operate the TORE. This alternate method eliminates the need for the flow splitting device and the restriction for reducing pressure. In this embodiment of the current invention, the wellbore desanding system comprises a fluidizing device having a supply duct and a discharge duct; and a pump functionally connected to the fluidizing device having a stator section and a rotor section, such that the rotor section comprises an inlet chamber arranged to receive production fluid from the well and feed it through the supply duct to the fluidizing device.

The current invention also relates to a wellbore desanding system comprising a fluidizing device in a well to continuously fluidize and lift solids from the well bottom thereby preventing accumulation of solids in the well, wherein the fluidizing device is connected to a downhole pump which in turn connects to a production tubing such that the supply duct is connected to an opening in the pump body (stator) and a discharge duct is connected to the suction of the pump. In an embodiment of the invention the fluidizing device is placed in the bottom of the well such as, for example, below the casing perforations. A further embodiment has supply duct or TORE inlet tube external to the pump casing.

The current invention also relates to a wellbore desanding system comprising a fluidizing device in a well to continuously fluidize and lift solids from the well bottom thereby preventing accumulation of solids in the well, wherein the fluidizing device is connected to a downhole pump which in turn connects to a production tubing such that the supply duct is connected to an opening in the pump rotor and a discharge duct is connected to the suction of the pump. In a further embodiment, the supply duct is integral to the rotor (or TORE priming rotor) In an embodiment of the invention the fluidizing device is placed in the bottom of the well such as, for example, below the casing perforations.

Another aspect of the current invention is a method for lifting oil from an underground petroleum reservoir through a well to the surface of the ground, wherein the method comprises placing a fluidizing device or TORE in the bottom of a well, passing the oil through the fluidizing device, passing the fluid from the fluidizing device into a pump, passing the fluid through a production tubing to the surface. In an embodiment of the invention the method further comprises passing the oil fluid through a pressure balance transition device after passing the oil fluid through the TORE. In yet another embodiment of the invention, the above method(s) further comprise passing the oil fluid through a flow splitting device in the production tubing so as to divert a portion of the fluids discharged from the pump into the conduit that is connected to the supply duct of the TORE. In another embodiment of the invention, the above methods may further comprise placing the fluidizing device below the casing perforations in the bottom of the well.

A further aspect of the current invention is a method for lifting oil from an underground petroleum reservoir through a well to the surface of the ground, wherein the method comprises placing a fluidizing device or TORE in the bottom of a well, passing the oil through the fluidizing device, passing the fluid from the fluidizing device into a pump, and passing the fluid through a production tubing to the surface such that the method(s) further comprises passing the oil fluid through a discharge port in the pump body or the pump rotor that diverts a portion of the flow from the mid-section of the pump at an appropriate pressure for feeding the TORE device. In another embodiment of the invention, the above methods may further comprise placing the fluidizing device below the casing perforations in the bottom of the well.

The current invention also provides for a method for lifting production fluid from an oil-producing wellbore comprising providing a fluidizing device comprising a supply duct and a discharge duct; providing a pump functionally connected to the fluidizing device and comprising a stator section end and rotor section, such that the stator section comprises an inlet chamber arranged to receive production fluid from the well and to feed the production fluid to the fluidizing device through the supply duct; passing the production fluid through the fluidizing device; and passing the production fluid from the fluidizing device to a production tubing.

The current invention also provides for a method for lifting production fluid from an oil-producing wellbore comprising providing a fluidizing device comprising a supply duct and a discharge duct; providing a pump functionally connected to the fluidizing device and comprising a stator section end and rotor section, such that the rotor section comprises an inlet chamber arranged to receive production fluid from the well and to feed the production fluid to the fluidizing device through the supply duct and wherein the supply duct is integral to the pump rotor; passing the production fluid through the fluidizing device; and passing the production fluid from the fluidizing device to a production tubing.

A further aspect of the invention is a method for desanding a wellbore wherein said method comprises placing a fluidizing device or TORE in the bottom of a well, passing the oil through the fluidizing device, passing the sand-laden fluid from the fluidizing device into a pump, passing the fluid through a production tubing to the surface. In an embodiment of the invention the method further comprises passing the oil fluid through a pressure balance transition device. In yet another embodiment of the invention, the above method(s) further comprise passing the oil fluid through a flow splitting device in the production tubing so as to divert a portion of the fluids discharged from the pump into the conduit that is connected to the supply duct of the TORE.

In yet another embodiment, the current invention provides for a method for desanding a wellbore comprises placing a fluidizing device such as a TORE in the well, passing the oil through the fluidizing device, passing the sand-laden fluid from the fluidizing device into a pump, passing the oil fluid through a discharge port in the pump body or the pump rotor that diverts a portion of the flow from the mid-section of the pump at an appropriate pressure for feeding the TORE device.

The current invention also provides for a method for desanding an oil-producing wellbore comprising providing a fluidizing device comprising a supply duct and a discharge duct; providing a pump functionally connected to the fluidizing device and comprising a stator section end and rotor section, such that the stator section comprises an inlet chamber arranged to receive production fluid from the well and to feed the production fluid to the fluidizing device through the supply duct; passing the production fluid through the fluidizing device; and passing the production fluid from the fluidizing device to a production tubing.

The current invention also provides for a method for desanding an oil-producing wellbore comprising providing a fluidizing device comprising a supply duct and a discharge duct; providing a pump functionally connected to the fluidizing device and comprising a stator section end and rotor section, such that the rotor section comprises an inlet chamber arranged to receive production fluid from the well and to feed the production fluid to the fluidizing device through the supply duct and wherein the supply duct is integral to the pump rotor; passing the production fluid through the fluidizing device; and passing the production fluid from the fluidizing device to a production tubing.

BRIEF DESCRIPTION OF THE DRAWINGS

An example of an oil-well and associated system, constructed in accordance with the present invention is illustrated diagrammatically in the accompanying drawings in which.

DETAILED DESCRIPTION

Figure 1:
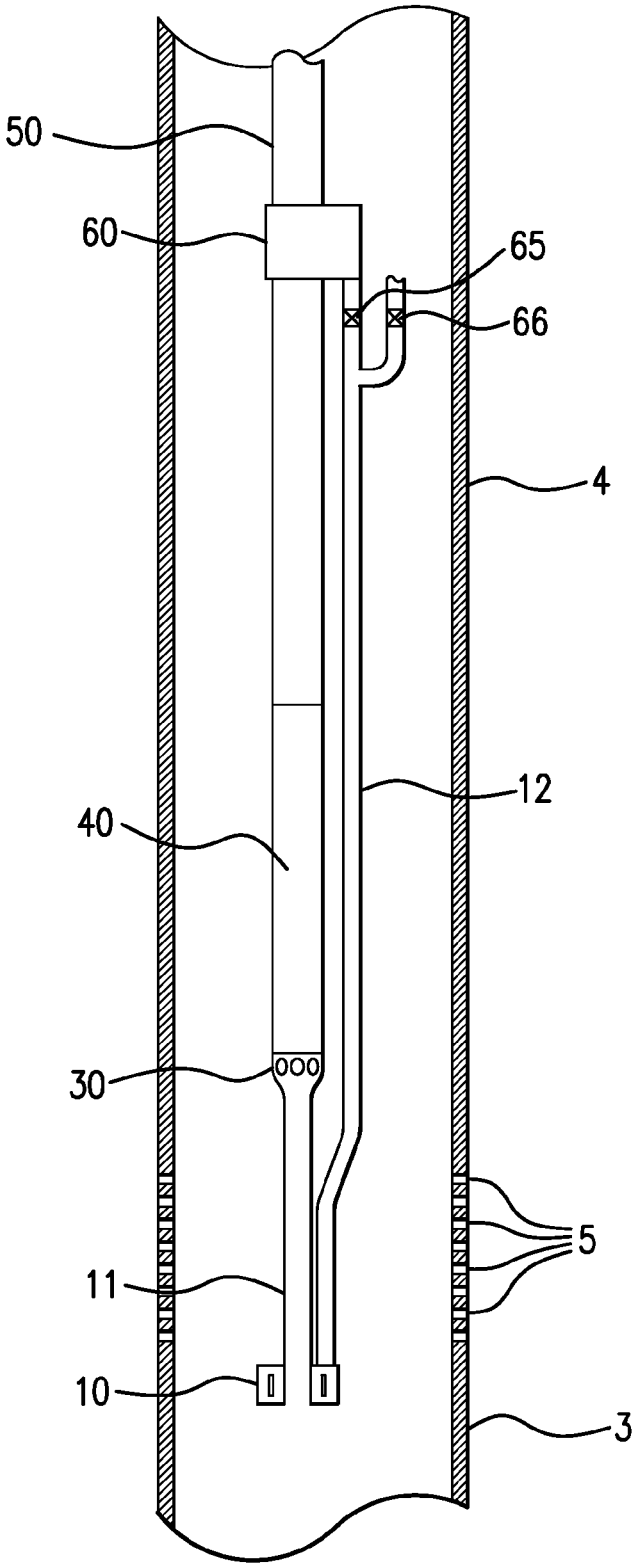
FIG. 1 schematically shows a partial view, in longitudinal section, of an embodiment of the present invention.

In accordance with the present invention, a wellbore desanding system is provided that comprises a fluidizing device at the bottom of the well, placed, for example, below the casing perforations in the bottom of the well, to continuously fluidize and lift solids from the well bottom thereby preventing accumulation of solids in the well that can stop the flow of fluids into the well, wherein the fluidizing device is connected to a pump such that the supply duct (water supply conduit for example) is connected to the discharge of the pump and a discharge duct is connected to the suction of the pump. Artificial lift of heavy oil with sand is primarily carried out by progressive cavity pumps or jet pumps. The current invention can be adapted to be used with any type of a downhole pump including progressive cavity and jet pumps.

Also in accordance with the present invention, a wellbore desanding system is provided that comprises a fluidizing device at the bottom of the well, placed, for example, below the casing perforations in the bottom of the well, to continuously fluidize and lift solids from the well bottom thereby preventing accumulation of solids in the well that can stop the flow of fluids into the well, wherein the fluidizing device is connected to a pump such that the supply duct (water supply conduit for example) is connected to an opening in the pump body or pump rotor and a discharge duct is connected to the suction of the pump.

Fluids entering an oil production well from an oil bearing reservoir must travel up through the well to reach the surface. The fluid pathway from the reservoir to the surfaces is usually as follows: 1. fluid passes from the reservoir through perforations in the well casing to enter the bottom of the well; 2. fluid travels up through the well casing to a pump which boosts the pressure of the fluid giving it the energy it needs to travel to the surface; 3. fluid exits the pump and enters the bottom of a small diameter production tubing; and 4. fluid travels up the production tubing to the surface. The velocity of the fluids travelling up the wellbore changes depending on the diameter of the conduit it is flowing through according to the formula $$v = \frac{4 * Q}{\pi * d^2}$$

Where: v=velocity, Q=flow rate and d=conduit diameter

Therefore, the fluids flowing through the large wellbore casing at the bottom of the well travel upwards at much lower velocity than fluids flowing through the production tubing.

Sand will fall downward through the upward flowing fluid at a velocity that is dependent on the size of the sand grains. In order to lift the sand from the well, the velocity of the fluid in the upward direction must be greater than the velocity of the sand falling through the fluid. Once the sand reaches the smaller diameter production tubing, the upward velocity within the tubing is high enough to carry the sand all the way to the surface. The desanding system of the current invention comprises a means for fluidizing the sand that settles through the slow moving fluid in the well casing, and to transport the sand through a small diameter conduit to the inlet of the pump.

TORE solid fluidizers are described in U.S. Pat. No. 4,978,251, U.S. Pat. No. 4,952,099, U.S. Pat. No. 4,992,006 and U.S. Pat. No. 5,853,266, all of which are incorporated herein by reference, and are well known by a person skilled in the art. In accordance with an embodiment of the present invention, a TORE is placed below the casing perforations in the bottom of a well.

As shown in FIG. 1, a well 3, is bored down with a casing 4. Production fluid enters the casing 4 through wellbore perforations 5 into a flow balancing transition device 30, into a pump 40, and into a flow splitting device 60. A portion of the production fluids passing through the flow splitting device 60 enter a TORE supply conduit 12 and into the supply duct of a TORE 10, wherein the TORE fluidizes solids in the bottom of a well 3 and passes the fluidized solids through the TORE 10 into the discharge duct 11 and into a flow balancing transition device 30 that receives the sand laden fluid from the TORE 10, mixes it with the well production fluids from the well casing 4 and feeds the combined stream to the inlet of a pump 40. The flow balance transition device is designed such that the well fluids entering the transition device from the casing will pass through a restricted area in order to create a zone of low pressure within the transition device. The difference in pressure between the casing 4 and the transition device 30 will then provide the energy required to lift the heavier sand laden fluid from the TORE discharge through the discharge duct 11 also referred to as a small diameter conduit) and into the transition device. Leaving the transition device 30, fluids enter the production tubing 50 through pump 40. The production tubing, in an embodiment of the invention, may comprise a flow splitting device 60, just after the discharge of the downhole pump. The flow splitting device 60 diverts a portion of the fluids discharged from the pump 40 into the conduit that is connected to the supply duct 12 of the TORE 10. The flow splitting device 60 includes a restriction that will reduce the pressure from the discharge of the pump and control the flow to the supply duct of the TORE.

The invention described is sufficient to remove sand from the bottom of the well during normal operation of the pump. In the above embodiment of the invention, the TORE is stationary (can be for example in the stator assembly of the pump). In this configuration the external capillary tube for the TORE feed may become damaged/blocked during installation or operation. An additional aspect of the invention is included to be able to recover operation of the pump in the event of a shut-down in which a large amount of sand enters the well and blocks the inlet to the transition device 30. The flow splitting device 60, will include an opening to the casing. The opening will have a non-return valve (check valve) 65 that only allows fluids to enter the conduit connected to the TORE supply duct. A second non-return valve 66 will be installed between the flow splitting device and the opening to the casing. This arrangement will allow pressurized fluid to be fed to the TORE supply duct either from the discharge of the pump, or from the casing. In the event that the transition device is covered with sand, water or fluid can be fed into the casing of the well from the surface. This water or fluid will pass through the TORE fluidizing the sand in the bottom of the well and discharging the sand laden fluid though the pump and into the tubing. Once the sand blocking the transition device has been removed, the pump can then be restarted so the remaining sand can be removed from the well. The complete system or arrangement enables an operator of the well to clear sand from the bottom of the well without removing the pump and tubing from the well, such as with the use of a surface pump, for example. This will greatly reduce the cost of operating wells that produce significant amounts of sand and that require periodic cleaning with expensive surface equipment.

Figure 2:
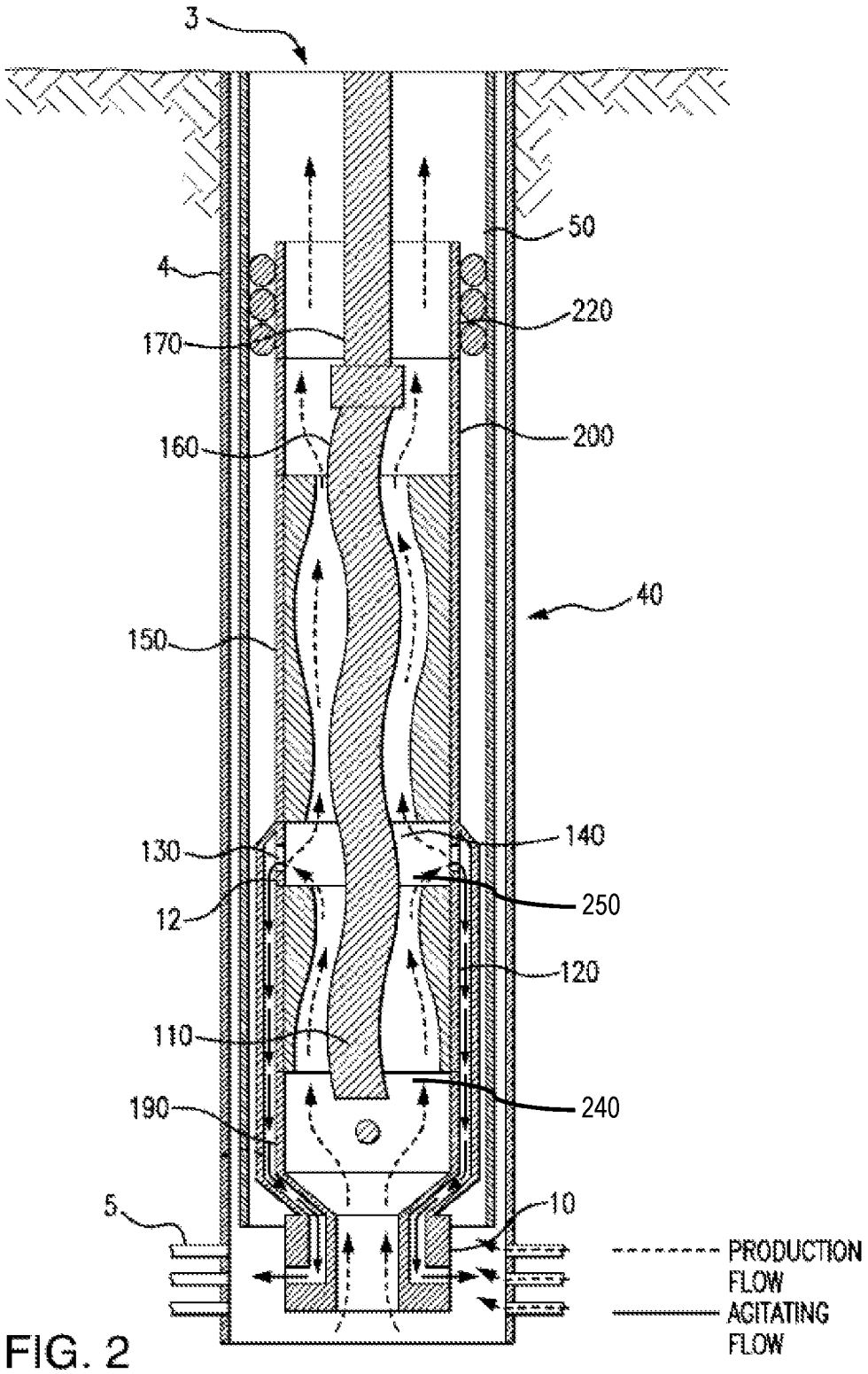
FIG. 2 schematically shows a partial view, in longitudinal section, of an alternate embodiment of the present invention in which the supply duct is connected to an opening in the pump body or stator.

As shown in FIG. 2, an alternate embodiment of the current invention is herein provided in which the supply duct 12 (referred to as TORE feed) is connected to a point in the pump stator rather than the discharge of the pump.

This embodiment circumvents having to regulate the differential pressure from the pump discharge. With the supply duct connected to a midpoint in the lift pump, for example, a constant feed pressure may be supplied to the TORE regardless of the depth of the well and the discharge pressure of the pump. According to this embodiment, a well 3 includes casing 4, production tubing 50 and sucker rod string 170. Inside the well, a fluid dispersing device, TORE 10 and a pump 40 is placed. The pump situated above TORE 10, includes a pump installation device 200, pump seating assembly 220, no-turn tool section 230 (not shown) and a tag bar assembly 190, TORE inlet coupling/rotor connector 140, TORE inlet tube 12 (supply duct which allows diverting a portion of the flow from the mid-section of the pump at an appropriate pressure for feeding the TORE device), TORE/priming stator 120 and production stator 150, TORE/priming rotor 110, and production rotor 160. Sand-laden production fluid enters the casing 4 through well perforations 5 and is mixed with fluid received from the TORE 10. The fluidized production flow continues upwards through a suction port 240, a space between the TORE/priming rotor 110 and the TORE priming stator 120, through a discharge port 250, and into a TORE inlet chamber 130 which is shown situated in the middle of pump 40. A portion of the fluid is diverted through a TORE inlet tube 12, down to the TORE 10 where it helps fluidize the produced sand as described above. The remaining sand-laden production fluid is lifted by pump 40 and travels upwards through production tubing 50. The agitating flow going down from the TORE inlet chamber 130 to TORE 10 is shown by solid arrows, whereas the fluidized production flow moving upwards in production tubing 50 is shown by broken arrows.

Figure 3:
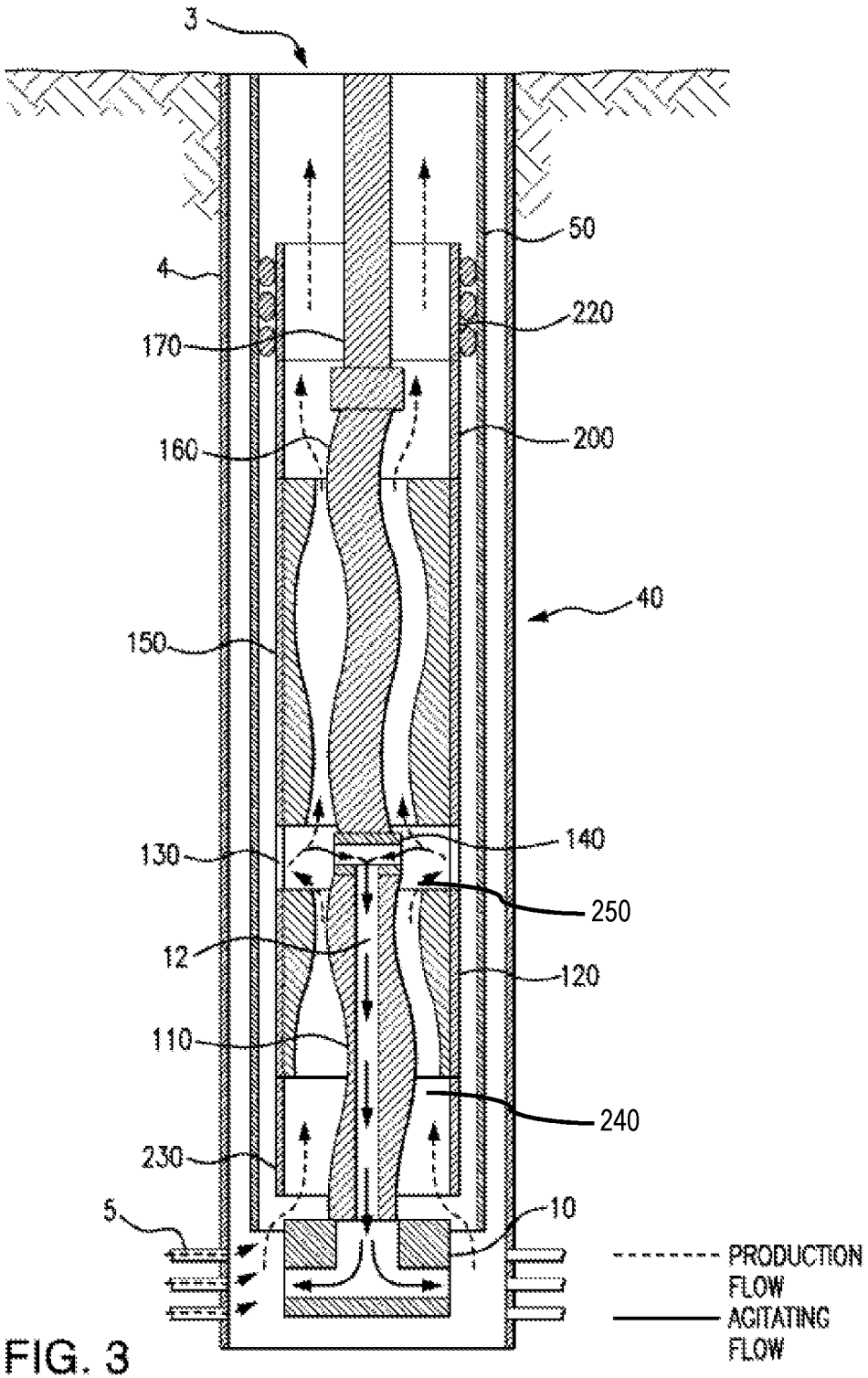
FIG. 3 schematically shows a partial view, in longitudinal section, of an alternate embodiment of the present invention in which the supply duct is connected to an opening in the pump rotor.

As shown in FIG. 3, an alternate embodiment of the current invention is herein provided in which the supply duct 12 (referred to as TORE feed) is connected to a point in the pump body rather than the discharge of the pump, such as for example through the lower rotor of the pump. In this embodiment, the supply duct 12 (TORE feed) is integral to the priming rotor 110 and the TORE unit can be part of the rotating assembly fitted on the end of the rotor.

This embodiment circumvents having to regulate the differential pressure from the pump discharge. With the supply duct connected to a midpoint in the lift pump, for example, a constant feed pressure may be supplied to the TORE regardless of the depth of the well and the discharge pressure of the pump. According to this embodiment, a well 3 includes casing 4, production tubing 50 and sucker rod string 170. Inside the well, a fluid dispersing device, TORE 10 and a pump 40 is placed. The pump situated above TORE 10, includes a pump installation device 200, pump seating assembly 220, no-turn tool section 230, TORE inlet coupling/rotor connector 140, TORE inlet chamber 130 (which allows diverting a portion of the flow from the mid-section of the pump at an appropriate pressure for feeding the TORE device), TORE/priming rotor 110, TORE/priming stator 120 and production stator 150, production rotor 160. Sand-laden production fluid enters the casing 4 through well perforations 5 and is mixed with fluid received from the TORE 10. The fluidized production flow continues upwards through a suction port 240, a space between the TORE/priming rotor 110 and the TORE priming stator 120, through a discharge port 250, and into a TORE inlet chamber 130 which is shown situated in the middle of pump 40. A portion of the fluid is diverted down to the TORE 10 where it helps fluidize the produced sand as described above. The remaining sand-laden production fluid is lifted by pump 40 and travels upwards through production tubing 50. The agitating flow going down from the TORE inlet chamber 130 to TORE 10 is shown by solid arrows, whereas the fluidized production flow moving upwards in production tubing 50 is shown by broken arrows.

What is claimed is:

1. A lift pump for use in a wellbore system including a production tubing and a fluidizing device configured for desanding the wellbore, the pump comprising:

a suction port configured for receiving fluid from the fluidizing device;

a priming rotor section rotatable in a priming stator section;

a discharge port configured for passing the fluid to a chamber;

a supply duct connected to the chamber and configured for feeding a portion of the fluid to the fluidizing device; and a production rotor section rotatable in a production stator section and configured for passing a reminder portion of the fluid to the production tubing, wherein the priming rotor section is rotationally coupled to the production rotor section.

2. The pump of claim 1, wherein the supply duct is integral with the priming rotor section.

3. The pump of claim 1, wherein the supply duct is external to a pump casing.

4. The pump of claim 1, further comprising a discharge duct connected between the suction port of the pump and the fluidizing device.

5. The pump of claim 4, wherein the discharge duct comprises a pressure balance transition device including inlets configured for entering wellbore fluid, and a low pressure zone, wherein the pressure balance transition device is configured for mixing the wellbore fluid with the fluid received from the fluidizing device.

6. The pump of claim 5, wherein the pressure balance transition device further includes a flow restriction area for generating the low pressure zone.

7. A method of lifting fluid from a wellbore, comprising:

placing a production tubing and a fluidizing device configured for desanding the wellbore in the wellbore;

rotating a priming rotor section within a priming stator section for sucking fluid from the fluidizing device;

discharging the fluid into a chamber;

rotating a production rotor section rotationally coupled to the priming rotor section within a production stator section for passing a portion of the fluid from the chamber to the production tubing; and feeding a remainder portion of the fluid to the fluidizing device via a supply duct connected to the chamber.

8. The method of claim 7, wherein the fluidizing device is placed below casing perforations.

9. The method of claim 7, further comprising:

entering wellbore fluid in a pressure balance transition device; and mixing the wellbore fluid with the fluid received from the fluidizing device in the pressure balance transition device.

10. The method of claim 9, further comprising generating a low pressure zone in the pressure balance transition device using a flow restriction area.

11. A lift pump for use in a wellbore system including a production tubing and a fluidizing device configured for desanding the wellbore, the pump comprising:

a suction port configured for receiving fluid from the fluidizing device;

a priming rotor section connected to the suction port and rotatably disposed in a priming stator section;

a discharge port connecting the priming rotor section to a chamber to pass the fluid to the chamber;

a supply duct connecting the chamber to the fluidizing device to feed a portion of the fluid to the fluidizing device; and a production rotor section connecting the chamber to the production tubing and rotatably disposed in a production stator section to pass a reminder portion of the fluid to the production tubing, wherein the priming rotor section is rotationally coupled to the production rotor section.

12. The pump of claim 11, wherein the supply duct is integral with the priming rotor section.

13. The pump of claim 11, wherein the supply duct is external to a pump casing.

14. The pump of claim 11, further comprising a discharge duct connected between the suction port of the pump and the fluidizing device.

15. The pump of claim 14, wherein the discharge duct comprises a pressure balance transition device including inlets configured for entering wellbore fluid, and a low pressure zone, wherein the pressure balance transition device is configured for mixing the wellbore fluid with the fluid received from the fluidizing device.

16. The pump of claim 15, wherein the pressure balance transition device further includes a flow restriction area for generating the low pressure zone.

* * * * *